US006554621B1

(12) United States Patent
Margalit et al.

(10) Patent No.: US 6,554,621 B1
(45) Date of Patent: Apr. 29, 2003

(54) CABLE APPARATUS

(75) Inventors: Yanki Margalit, Ramat Gan (IL); Dany Margalit, Ramat Gan (IL)

(73) Assignee: Aladdin Knowledge Systems, Ltd., Tel Aviv (IL)

( * ) Notice: Subject to any disclaimer, the term of this patent is extended or adjusted under 35 U.S.C. 154(b) by 0 days.

(21) Appl. No.: 09/616,669

(22) Filed: Jul. 14, 2000

(30) Foreign Application Priority Data

Jul. 14, 1999 (IL) ..... 130944

(51) Int. Cl.[7] ..... H01R 13/60
(52) U.S. Cl. ..... 439/41; 439/528
(58) Field of Search ..... 439/41, 105, 502, 439/528

(56) References Cited

U.S. PATENT DOCUMENTS 4,055,249 A * 10/1977 Kojima ..... 206/447
4,560,216 A * 12/1985 Egawa ..... 439/12
5,308,253 A * 5/1994 Maki ..... 439/148
5,903,869 A * 5/1999 Jacobson et al. ..... 704/272
6,071,142 A * 6/2000 Blackman ..... 439/373

OTHER PUBLICATIONS

What?is.com, "FireWire", http://www.whatis.com (web pages), pp. 1–3, Aug. 15, 2000.
Cypress: Universal Serial Bus (USB), http://www.cypress-.com (web pages), pp. 1–2, 2000.
Universal Serial Bus, "Welcome", http://www.usb.org/features.html (web pages), pp. 1–5, Aug. 20, 2000.
MSH002—Multi Function Mouse Holder (Product Detail), http://www.aidatamall.aa (web page), p. 1, Aug. 17, 2000.
USB.org—FAQ, http://www.usb.org/faq/ans2.html (web page), p. 1, Aug. 15, 2000.

* cited by examiner

*Primary Examiner*—Renee Luebke
*Assistant Examiner*—Phuongchi Nguyen
(74) *Attorney, Agent, or Firm*—Townsend and Townsend and Crew LLP

(57) ABSTRACT

This invention discloses a cable apparatus for use in conjunction with a computer system having a first socket disposed in the rear thereof in order to accommodate at least one cable without occupying a workspace of a user of the computer system, and a frequently disconnected peripheral unit which includes a second socket via which a peripheral unit is frequently connected to the computer system and frequently disconnected therefrom, the cable apparatus including a cable, at a first end of the cable, a third socket mating with the first socket, and at a second end of the cable, the cable includes a fourth socket mating with the second socket and a cable end adherent operative to attach the second end of the cable to a user-selected surface within the workspace.

9 Claims, 3 Drawing Sheets

CABLE APPARATUS

BACKGROUND OF THE INVENTION

The present invention relates to a cable apparatus in general, and in particular, to a cable apparatus for use in conjunction with a computer system. The use of cable apparatus, including standard cable apparatus, in conjunction with computer systems, is well known in the art. State of the art connector technology, which may be used in cable apparatus, includes:

- the USB interface, described in specifications available over the Internet at www.usb.org; and
- firewire technology, also known a IEEE 1394 technology, which is alternative to USB and also provides flexible connectivity, and is described in the IEEE 1394 standard.

In computer systems, cable apparatus is typically connected to a computer at a socket disposed in the rear thereof. FIG. 1 shows a typical example of connecting cable apparatus to a socket disposed in the rear of a computer. It is appreciated that it may be physically awkward for a user of a computer system to gain access to the rear of a computer in a typical installation. In the case of a frequently connected and disconnected peripheral unit, which may comprise either a standard peripheral unit or a plug which is recognized by software running on the computer and which is generally intended to provide copy protection, as is well known in the art, the awkwardness of connection and disconnection at the rear of the computer may be particularly unpleasant for the user.

FIG. 2 shows a prior art receptacle for receiving a computer mouse at the front of a computer system. The receptacle is typically attached to the computer system with double-sided tape or with similar apparatus. Such a receptacle is commercially available as a mouse holder, model msh-002, from Aidata.

The disclosures of all references mentioned above and throughout the present specification are hereby incorporated herein by reference.

SUMMARY OF THE INVENTION

The present invention seeks to provide improved cable apparatus for use in connection with a computer system.

The awkwardness of accessing a socket at the rear of a computer is very well known, as has been described above. Apparatus for receiving a computer mouse at the front of a computer system is also well known. Despite the above, the prior art does not show cable apparatus, for use in conjunction with a computer system, for making a socket available in the user workspace, preferably at a user selected location. In one aspect of the present invention, a solution to the deficiencies of the prior art is provided in the form of cable apparatus which provides a socket, with one end of the cable being attachable to a user-selectable surface within the user's workspace.

There is thus provided in accordance with a preferred embodiment of the present invention cable apparatus for use in conjunction with a computer system having a first socket disposed in the rear thereof in order to accommodate at least one cable without occupying a workspace of a user of the computer system, and a frequently disconnected peripheral unit which includes a second socket via which a peripheral unit is frequently connected to the computer system and frequently disconnected therefrom, the cable apparatus including a cable, at a first end of the cable, a third socket mating without the first socket, and a second end of the cable a fourth socket mating with the second socket, and a cable end adherent operative t attach the second end of the cable to a user-selected surface within the workspace.

Further, in accordance with a preferred embodiment of the present invention, the cable apparatus also includes an FCCS plug including the second socket.

Still further in accordance with a preferred embodiment of the present invention the cable end adherent includes a suction cup.

Additionally, in accordance with a preferred embodiment of the present invention, the second end of the cable is attached to a location proximate to the front end of the computer system.

Moreover, in accordance with a preferred embodiment of the present invention, the apparatus also includes a smooth sticker for applying to rough surfaces unsuitable for adherence by the suction cup.

BRIEF DESCRIPTION OF THE DRAWINGS

The present invention will be understood and appreciated more fully from the following detailed description, taken in conjunction with the drawings in which.

DESCRIPTION OF THE SPECIFIC EMBODIMENTS

Figure 1:
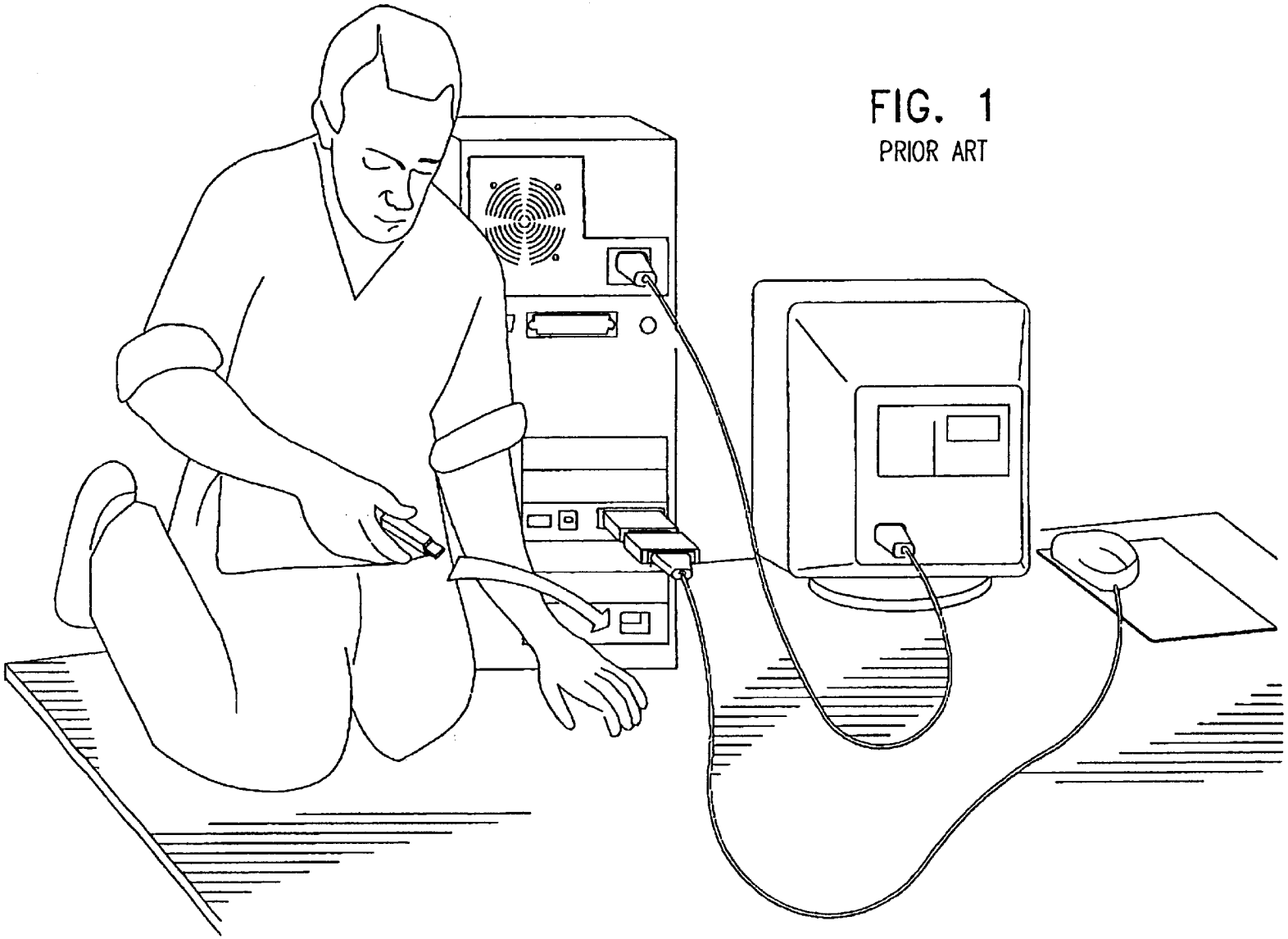
FIG. 1 PRIOR ART
FIG. 1 is a simplified pictorial illustration of a prior art socket disposed in the rear of a computer.
Figure 2:
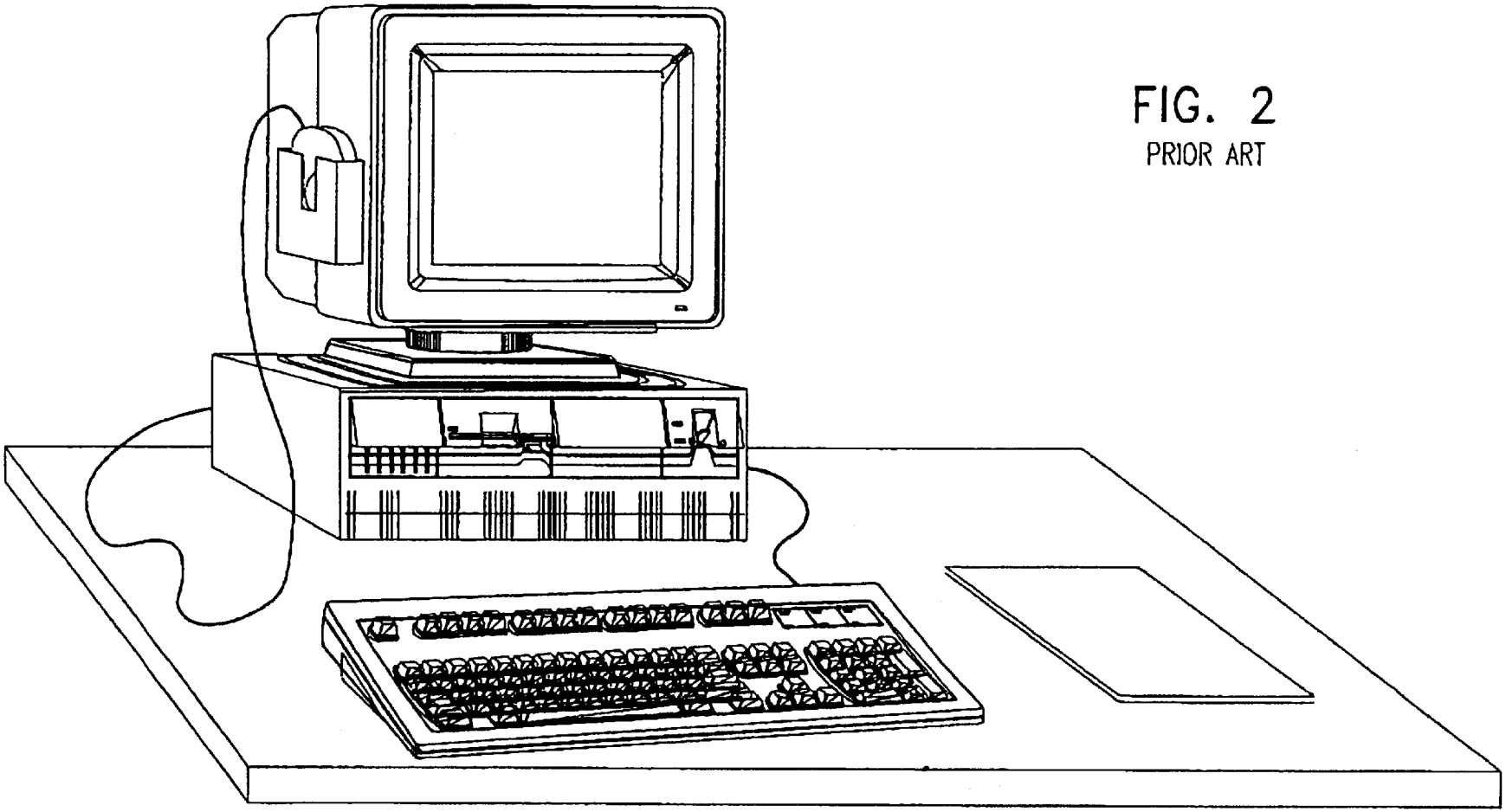
FIG. 2 PRIOR ART
FIG. 2 is a simplified pictorial illustration of a prior art receptacle for receiving a computer mouse at the front of a computer system.
Figure 3:
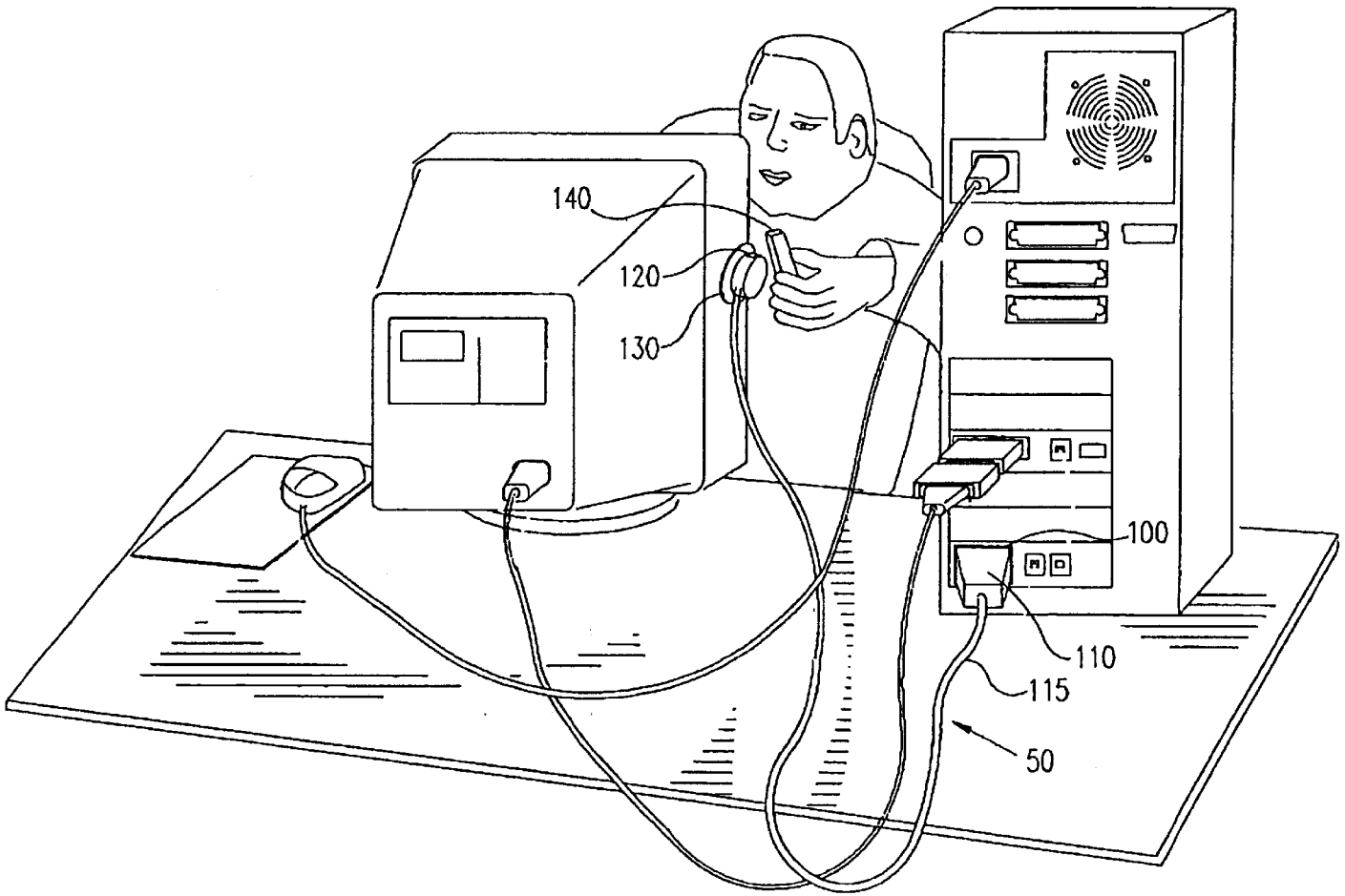
FIG. 3 is a simplified pictorial illustration of cable apparatus constructed and operative in accordance with a preferred embodiment of the present invention.

Reference is now made to FIG. 3, which is a simplified pictorial illustration of cable apparatus 50 constructed and operative in accordance with a preferred embodiment of the present invention. Cable apparatus 50 is generally intended for use with a computer system, portions of which are also shown in FIG. 1 and described below.

The computer system preferably comprises a first socket 100. The first socket 100 preferably, but not necessarily, comprises an FCCS socket. The first socket 100 is preferably designated to mate with a second socket 140, described below.

The present invention is believed to be particularly useful when used as part of a flexibly connectable computer system, although the present invention is not limited to use with a flexibly connectable computer system.

In a state of the art computer system, also terms herein a "flexibly connectable computer system," the computer and the peripherals each include at least one identical port having a mating port on any other computer and any other peripheral, such that any peripheral can be selectably connected to any computer or to any other peripheral. Also, a peripheral may be connected to the computer not directly as in conventional computer system, but rather via another peripheral. There is generally always a port available on one or more connected peripherals in an existing computer system such that another peripheral can generally always be connected to an existing computer system.

One example of a flexibly connectable computer system is a USB (universal standard bus) computer system in which the computer and each peripheral includes a USB port.

Another example of a flexibly connectable computer system is the recently contemplated Firewire system.

The term "FCCS plug" is used throughout the present specification and claims to refer to a portable device which mates with a flexibly connected computer system and, as opposed to peripherals which contain mechanical elements, typically comprises only memory and/or CPU and therefore is typically pocket size. It is appreciated that, because each peripheral connected onto a flexibly connectable computer system typically has at least one port, also termed herein a socket, a flexibly connectable computer system of any configuration typically has at least one vacant port available to interact with an FCCS plug. USB tokens and Rainbow tokens are both examples of FCC plugs.

Cable apparatus 50 preferably comprises a third socket 110, at a first end of a cable 115, the third socket 110 being operative to mate with the first socket 100.

At a second end of the cable 115, the cable apparatus 50 preferably comprises a fourth socket 120, which is preferably operative to mate with the second socket 140. It is appreciated that the second socket 140 may be comprised in an FCCS plug, as shown, or may be comprised in any suitable peripheral device.

At the second end of the cable 115, the cable apparatus 50 also preferably comprises a cable end adherent 130. The cable end adherent 130 may comprise any one or more suitable adherents, such as: a suction cup, as shown in FIG. 1; a smooth sticker such as appropriate adhesive tape, preferably adapted to stick to rough surfaces unsuitable for a suction cup; or a hook-and-loop fastener, with one side of the fastener typically being fixedly attached to a surface and a second side thereof being fixedly attached to the cable 115. It is appreciated that it may be preferable to provide more than one suitable adherent, so that attachment to different types of surfaces will be facilitated. Preferably, the cable end adherent 130 is attached to a user-selectable surface within a workspace of a user of the computer system, so as to position the fourth socket 120 in an accessible location within the workspace as chosen by the user.

The operation of the apparatus of FIG. 3 is now briefly described.

It is appreciated that, in the prior art as described above with reference to FIG. 1, it would be necessary for the user of the computer system to obtain access to the rear thereof in order to connect and disconnect, typically frequently, the second socket 140 to and from the first socket 100.

In the embodiment of FIG. 3, the cable 115 provides a connection for the second socket 140 at a user-selectable location in the workspace by carrying appropriate signals between the first socket 100 and the second socket 140 via the third socket 110 and the fourth socket 120. It is appreciated that the embodiment of FIG. 3 may therefore be particularly useful in a case where the fourth socket 120 is frequently connected and disconnected, and may also be replaced from time to time with other sockets (not shown), as may be the case when the second socket 140 is comprised in an FCCS plug as described above.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited by what has been particularly shown and described hereinabove.

Rather, the scope of the invention is defined only by the claims which follow:

1. A cable apparatus for connecting a peripheral unit with a computer system, said computer system comprising a first socket disposed in the rear thereof for accommodating at least one cable, said peripheral unit comprising a second socket for connecting said peripheral unit with a computer system, the cable apparatus comprising:

a cable including a first end and a second end;

said first end comprising a third socket for mating with the first socket; and said second end comprising:

a fourth socket for mating with the second socket of said peripheral unit; and a cable end adherent operative to attach the second end of the cable to a user-selected surface within a workspace, wherein said cable end adherent comprises a suction cup, further comprising a smooth sticker for applying to rough surfaces unsuitable for adherence by said suction cup.

2. The apparatus as recited in claim 1, wherein said cable end adherent comprises a suction cup.

3. The apparatus as recited in claim 1 wherein said second end of the cable is attached to a location proximate to the front end of the computer system.

4. A cable apparatus for connecting a peripheral unit with a computer system, said computer system comprising a first socket disposed in the rear thereof for accommodating at least one cable, said peripheral unit comprising a second socket for connecting said peripheral unit with a computer system, the cable apparatus comprising:

a cable including a first end and a second end;

said first end comprising a third socket for mating with the first socket; and said second end comprising:

a fourth socket for mating with the second socket of said peripheral unit; and a cable end adherent operative to attach the second end of the cable to a user-selected surface within a workspace, wherein said second socket of said peripheral unit comprises an FCCS plug.

5. The apparatus as recited in claim 4, wherein said cable end adherent comprises a suction cup.

6. A method for conveniently connecting and disconnecting a first connector of a peripheral to and from a second connector of a computer, said second connector being located at an inconvenient-access location in said computer, the method comprising:

providing an extension cord, functionally-corresponding to said first and second connectors, said extension cord having a third connector, functionally-corresponding with said second connector, for connecting said extension cord with said second connector; and a fourth connector, functionally-corresponding with said first connector, for connecting said extension cord to said first connector;

connecting said third connector to said second connector, thereby connecting said extension cord to said computer; and placing said fourth connector in a conveniently-accessible location, thereby allowing convenient connection and disconnection of said first connector to and from said extension cord, thereby functionally-connecting and disconnecting said first connector to and from said second connector, wherein said connectors correspond to an FCCS standard.

7. A method according to claim 6, wherein said attaching comprises attaching a suction cup associated with the extension cord to said object.

8. A method according to claim 6, further comprising attaching the end of said cord which corresponds to said fourth connector to an object positioned at said conveniently accessible location.

9. A method according to claim 8, wherein said attaching comprises attaching an adherent associated with said extension cord to said object.

* * * * *